United States Patent [19]

Kish

[11] Patent Number: 4,969,399

[45] Date of Patent: Nov. 13, 1990

[54] ACOUSTIC MINE COUNTERMEASURES

[75] Inventor: Louis A. Kish, Panama City, Fla.

[73] Assignee: The United States of America as represented by the Secretary of the Navy, Washington, D.C.

[21] Appl. No.: 329,321

[22] Filed: Dec. 9, 1963

[51] Int. Cl.[5] ..... F42B 22/42

[52] U.S. Cl. ..... 102/402; 116/DIG. 18; 116/137 R; 367/1

[58] Field of Search ..... 340/12, 12 ARC

*Primary Examiner*—David H. Brown

*Attorney, Agent, or Firm*—Harvey David; John Becker; Sol Sheinbein

[57] ABSTRACT

A mine sweeping method and related apparatus for achieving at least temporary passivation of underwater acoustic influence mines, by the generation of particular underwater sounds of progressively increasing intensity. The water is by repetitively injecting into the water individual metered slugs of heated water, which water is heated to its saturation pressure but below the critical point. The metered slugs of heated water may be of the same or of progressively increasing size, i.e. weight, and can be released from a heated pressure chamber into the water from either a stationary array or from an array towed from a moving ship, and at a depth such tht the expanding bubbles, produced by the change of state of the heated water, do not break the water surface. The rapid expansion of the metered slugs produce the desired sound output for temporarily rendering the acoustic influence mines passive by actuating their anticountermine circuits.

5 Claims, 2 Drawing Sheets

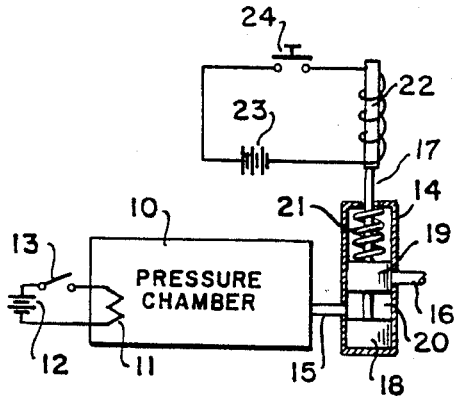
FIG. 1.
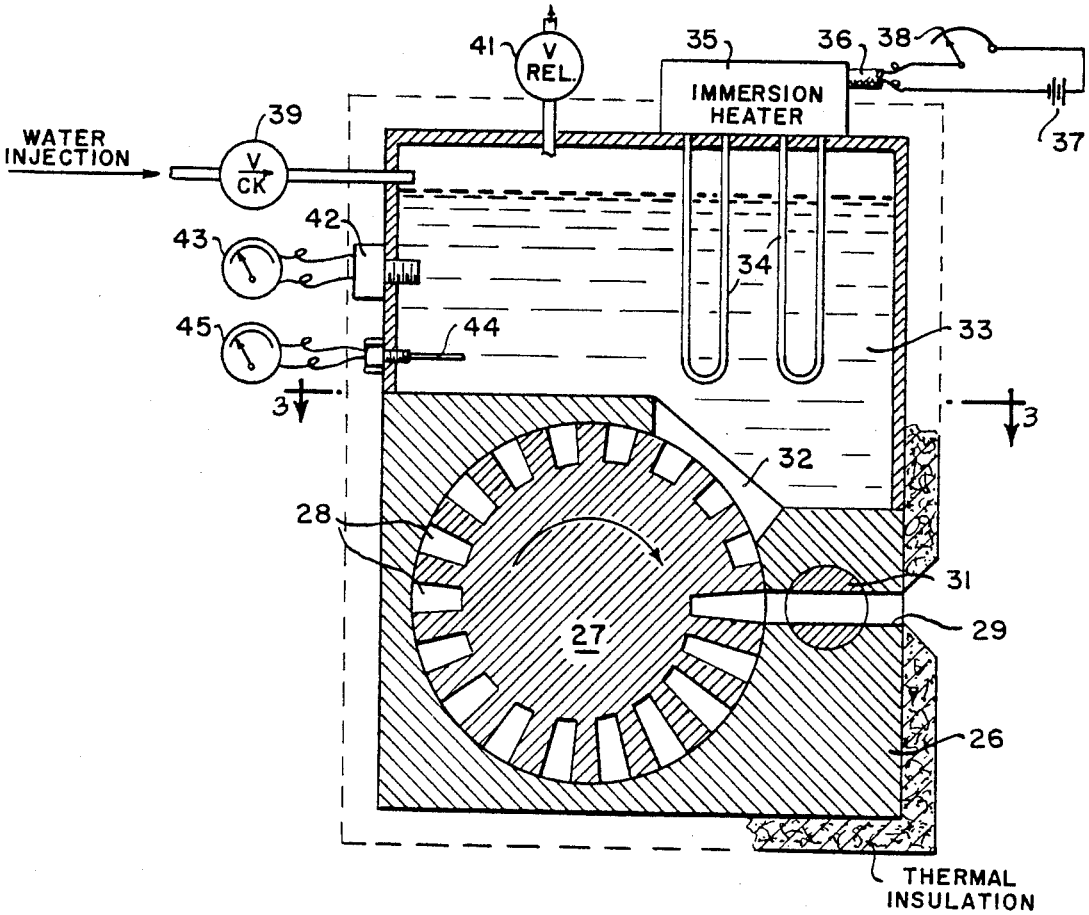

ACOUSTIC MINE COUNTERMEASURES

The invention described herein may be manufactured and used by or for the Government of the United States of America for governmental purposes without the payment of any royalties thereon or therefor.

The present invention relates to underwater acoustics and more particularly to a method and apparatus for actuating or rendering passive acoustic influence mines. Generally, acoustic mines are characterized by firing mechanisms which are responsive to acoustic signals within the frequency spectrum of the acoustic signature of the type ship chosen as a target and of progressively increasing intensities due to the motion of the ship as it approaches and passes the mine. Ordinarily an acoustic mine is also provided with an anticountermine (ACM) mechanism which discriminates against noise fields in which the rate of change is too high to have been produced by a ship traveling at speeds expected of target ships. This ACM mechanism renders the mine firing mechanism passive for a selected interval of time in order to reduce the vulnerability of the mine to explosive sweeping.

Heretofore, acoustic mines have been rendered passive by periodically producing underwater explosions, e.g., hand grenades, to produce strong pulse acoustic signals to which ACM mechanisms respond for rendering the mines temporarily passive so that a ship may safely pass thereover. Many methods and apparatus have also been developed for producing underwater sound or noise of increasing intensity for the sweeping, i.e., firing, of acoustic mines. One such prior method involved the delivery of bubbles of steam through a flapper valve directly into the water, the idea being that the internal pressure of the steam being well above hydrostatic would cause the steam to expand; the kinetic energy of the expanding water would carry it past its equilibrium radius; and the bubble would then collapse due to heat loss and resulting condensation. All such known arrangements have too low an overall acoustic efficiency to be practical. It is thought that the low efficiency is due in part at least to the possibility that the steam did not expand appreciably due to the rapid heat transfer and condensation. At the present time, there appears to be no practical solution to the problem of metering steam from a steam generator into the water without too great an initial conversion of heat energy to kinetic energy.

In accordance with the present invention the problems of steam delivery are eliminated by using water rather than steam as the working substance. It is known that water may be heated as a liquid to the critical point (705.4° F.) provided the pressure is increased to correspond to a value higher than the saturation pressure and that if the heated water is suddenly subjected to a lower pressure a portion of the water will flash into steam with explosive violence as witnessed by boiler explosions. For example, a pound of water at 200 psia and 381.1° F. having a volume of 0.01839 $ft^3$ will at 20 psia generate steam having a volume of 2.98 $ft^3$., assuming the steam expands isentropically to the low pressure under adiabatic conditions and 14.9% of the water, by weight, flashes into steam. The ratio of volume increase is about 160 to 1 as compared with 4.9 to 1 for expansion of steam between the same pressure difference which reflects a very considerable advantage in favor of delivering a low specific volume of water at "boiler pressure" over delivering a large volume of steam possessing a high kinetic energy and "premature expansion."

It is theorized that the heated water when exposed to the ambient pressure initially vaporizes sufficiently to build up the pressure to approach the saturation pressure of the heated water and as expansion continues the vaporization proceeds at decreasing pressures until the minimum pressure is reached. During such expansion, work is done on the ambient water and in all probability overexpansion occurs as with an underwater explosion. Subsequent condensation and collapse of the expanded bubble produces underwater noise of a nature associated with cavitation. Repetition of this process at short intervals of time, say each ½ second, and at increasing levels of amplitude provides a sound source suitable for sweeping, i.e., actuating, acoustic mines. Operation of the process at large amplitude and at widely spaced intervals of time, say once each 5 seconds, provides a sound source suitable for anticounter-mining (ACM) purposes.

An object of the invention is the generation of underwater sound.

Another object of the invention is the generation of underwater sound of large amplitude suitable for rendering an acoustic mine temporarily passive.

Still another object of the invention is the provision of a method and apparatus for generating underwater sound of progressively increasing intensity.

Other objects and advantages of the invention will become apparent from the following description of preferred embodiments thereof and their modes of operation.

In accordance with a preferred embodiment of the invention, the foregoing object of rendering an acoustic mine passive temporarily to allow the safe transit of a ship is accomplished by injecting into the water a single slug of water heated to its saturation pressure but below the critical point.

In accordance with another preferred embodiment of the invention, the foregoing object of sweeping acoustic mines is accomplished by dispensing under water metered slugs of heated water in progressively increasing size, i.e., weight, at substantially equal intervals of time, say ½ second, and for a total duration at least equal to the time interval required to fire the suspected mines. This latter type of operation is generally referred to as modulated operation.

In practice, the heated water may be released into the water from a stationary array or from an array towed from a moving ship and at a depth such that the expanding bubbles produced by the change of state of the heated water does not break the water surface.

The invention will be better understood from the following description when read in connection with the accompanying drawings in which FIG. 1 shows diagrammatically a metering arrangement for unmodulated operation;

FIGS. 2 and 3 are sectional side and top views, respectively, showing a control and metering assembly for modulated operation;

Figure 3:
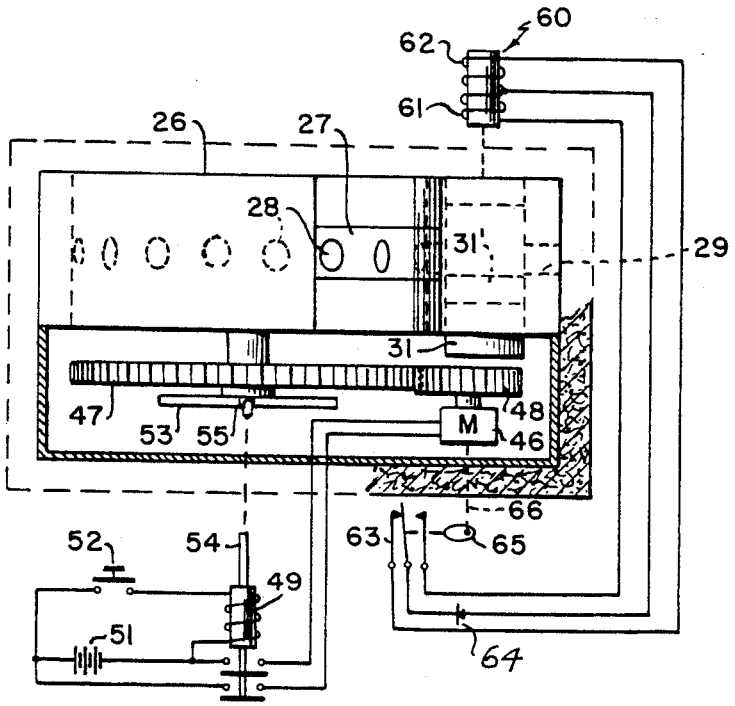
Figure 4:
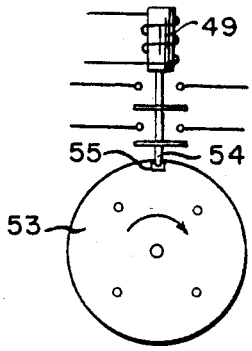
FIG. 4 illustrates a portion of the control arrangement employed in FIG. 3.

Referring now to the drawings, FIG. 1 is a conventionalized showing of a pressure chamber 10 in which water is heated by a heater element 11 which is heated by application thereto of the current of a battery or other power source 12 when a switch 13 is closed. A metering assembly for unmodulated operation includes a cylinder 14 having an inlet passage 15 connected to the pressure chamber 10, a dispensing or exit port 16, and a two piston valve slidable within the cylinder, the inlet passage 15 being offset from the exit port 16 longitudinally of the cylinder 14. The two pistons 18 and 19 of the valve 17 define between them and with the wall of the cylinder 14 a measuring chamber 20 which is in communication with the inlet passage 15 when the valve 17 is at the rest position shown in FIG. 1. The valve 17 is suitably biased, as by a spring 21, to the rest position and is moved by motor means, here shown as a solenoid 22 connected to be energized by a battery 23 upon the closure of a switch 24, to a dispensing position in which the measuring chamber is connected to the exit port 16 and is disconnected from the inlet passage 15. This operation ejects or dispenses a slug of water through the exit port 16 into the water when the exit port is submerged and the resulting rapid expansion of the slug produces the desired sound output for rendering passive acoustic mines by actuating their ACM circuits. The sound output depends upon the temperature of the ejected water and the volume of the measuring chamber 20.

One apparatus suitable for practicing the mine sweeping method of the invention, i.e., modulated operation, is shown in FIGS. 2 and 3 as comprising a metering assembly including a housing 26 in which is rotatably mounted a metering drum 27 designed to rotate clockwise as viewed in FIG. 2. The drum 27 embodies a plurality of wells, i.e., blind holes, 28 spaced circumferentially around the drum 27 at equal intervals, the spacing between the centers of adjacent wells 28 being at least equal to twice the diameter of the wells 28. The volumes of the several wells 28 increase progressively counterclockwise as indicated in FIG. 2 by their increasing depths. The housing 26 has an outlet port 29 alined with the circumference of the drum 27 on which the wells 28 are centered and containing a valve means 31 for controlling the opening and closing of the outlet port 29. At a small distance counterclockwise from the outlet port 29 a portion of the well-containing circumference of the drum 27 is in constant communication through an opening 32 in the housing 26 with the water in a pressure chamber 33. Water in the chamber 33 is heated to the desired temperature and pressure by the heat exchange elements 34 of an immersion heater 35 connected through a power cable 36 to a suitable source of power 37. A rheostat 38 in series with the power source 37 provides means for controlling the heating of the water in the chamber 33. Water is injected into the chamber 33 through a check valve 39 and protection against excess pressure is provided by a relief valve 41. A pressure transducer 42 provides pressure information on a gage 43 and a thermocouple element 44 provides temperature information on a gage 45.

The drum 27 is adapted to be rotated clockwise by a motor 46 through gears 47 and 48 for a single revolution under the control of a latching relay 49. The motor 46 is adapted to be connected to a suitable source of power 51 through the contacts of the relay 49 by pressing a push-button switch 52. Momentary closure of the switch 52 connects the relay 49 across the power source 51. Energization of the relay 49 lifts its latch 54 from a notch 55 in a cam 53 and connects the motor 46 to the source 51 and the motor 46 starts turning to rotate the gear 47. Mounted for rotation with the gear 47 is the cam 53 the initial rotation of which latches the relay 49 in closed position until the latch 54 again falls into the notch 55 in the cam 53 at which time the relay 49 opens to stop the motor 46 and the drum 27 stops in the desired position, shown in FIG. 2, for starting another operating cycle. Each operating cycle produces a series of acoustic pulses of increasing amplitude thereby simulating signals produced by a ship approaching a mine.

The valve means 31 is caused to open and close the outlet port 29 in timed relation with the rotation of the drum 27 so that the transverse bore 31' in the valve means 31 is alined with the outlet port 29 only when a well 28 is alined with the outlet port 29. The required rapid reciprocating movement of the valve means 31 is accomplished by a push-pull motor 60 which may be pneumatically powered but is here shown as actuated by an electromagnet including windings 61 and 62, the winding 61 when energized serving to move the valve 31 to the closed position shown in FIG. 3 and the winding 62 when energized functioning to move the valve 31 to the open position, i.e., its bore 31' alines with the outlet port 29. The required timing of the actuation of the valve 31 may be accomplished by means of a double throw switch 63 which may take the form of leaf springs biased to the position connecting the coil 61 in series with a battery 64 and adapted to be moved periodically to disconnect the coil 61 and to connect the coil 62 in series with the battery 64 as by a cam 65 rotated by the shaft 66 of the motor 46.

Figure 5:
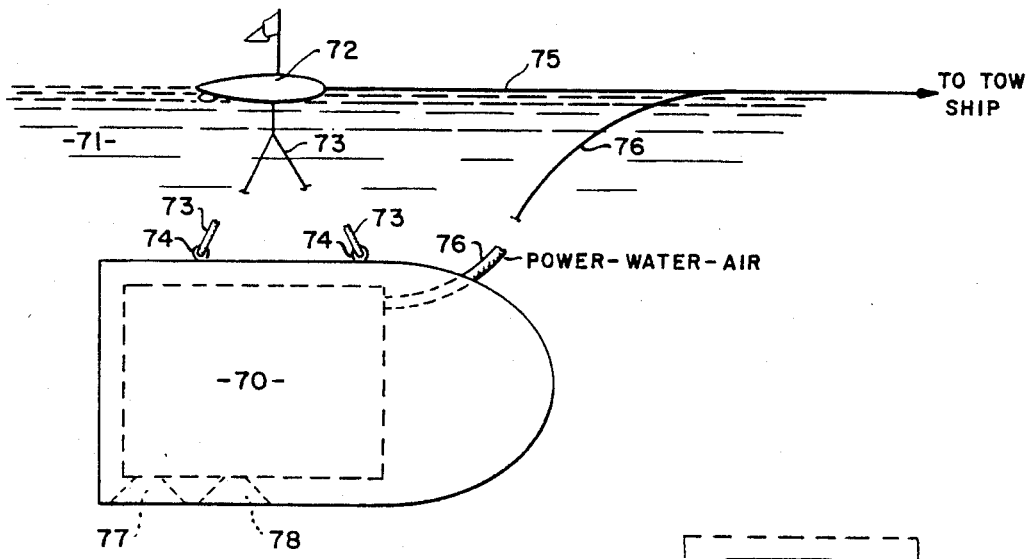
FIG. 5 shows an array according to the invention streamed for tow in a body of water.

In FIG. 5 an underwater sound generator 70 is shown supported at a suitable depth, say 25 to 30 feet, in a body of water 71 by a float 72 through cables 73 secured to the float 72 and to lifting pods 74 provided on the generator 70. The float 72 is shown in position to be towed through the body of water 71 by a tow cable 75 streamed from a towing ship not shown. A cable 76 for providing utilities such as electric power, water, air, and control lines to the generator 70 streamed from the tow ship and preferably married to the tow cable 75 extends into the forward end of the generator 70. The generator 70 is heavily insulated against heat loss to the water 71 and is preferably faired for reducing drag when under tow. It is to be understood that the generator 70 preferably incorporates both unmodulated and modulated water dispensing or metering arrangements having separate outlet ports 77 and 78.

Figure 6:
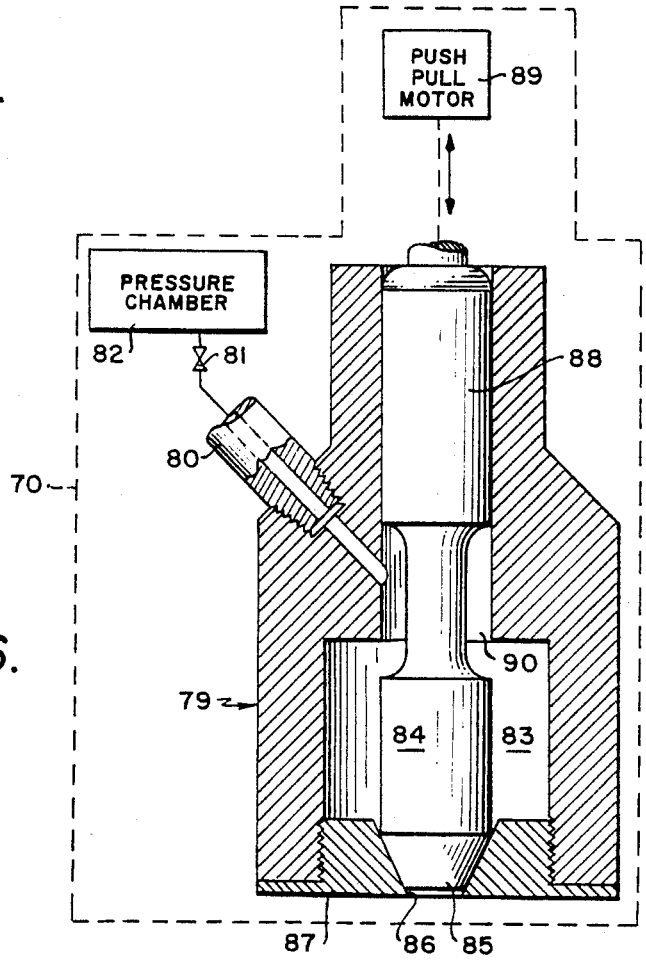
FIG. 6 shows a modification of the metering device of FIG. 1.

Another form of metering device for unmodulated operation of the generator 70 is shown in FIG. 6 as comprising a valve 79 of the sliding piston type connectable through a line 80 and a cut-off valve 81 to a source 82 of superheated water which may comprise the pressure chamber 33 shown in FIG. 2. The body of the valve 79 defines a metering chamber 83 surrounding a piston 84 the distal end 85 of which is shaped to mate with a seat 86 formed in the outlet of the end plate 87. The valve stem 88 has a diameter equal to the diameter of the piston 84 so that the push-pull motor 89 which actuates the valve 79 does not have to operate against a hostile pressure. The throw of the piston 84 is such that shortly after it lifts from the seat 86 its upper end enters the cylinder 90 in which the stem 88 slides to thereby prevent flow of water through the line 80 until the piston again moves to closed position at which time the chamber 83 is filled. Thus, each time the valve 79 is opened a measured volume of water is dispensed.

Exemplary operating parameters for each mode of operation may vary over wide limits depending on the sound output desired. With equal size slugs of water, the output may be varied by varying the water temperature. Experiments indicate that the temperature should be at least 380° F. and less than the critical temperature 705.4° F. Accordingly, as used in the appended claims, the term high temperature is employed to mean greater than 380° F. and less than 705.4° F. For unmodulated operation the slug size may be 0.1 pound or greater. For modulated operation, the slug size may be increased gradually from about 0.1 pound to 1 lb. more or less depending on the over-all amplitude of modulation desired.

Obviously many modifications and variations of the present invention are possible in the light of the above teachings. It is therefore to be understood that within the scope of the appended claims the invention may be practiced otherwise than as specifically described.

What is claimed is:

1. In the art of producing underwater sound in a body of water the herein described improvement which comprises the step of dispensing under water a slug of water heated to a temperature such that when suddenly exposed to the ambient pressure at least a portion of the water in the slug will flash into steam.

2. Apparatus for producing underwater acoustic signals in a body of water comprising a housing adapted to be submerged in said body of water, an outlet port in said housing adapted to be submerged when said housing is submerged, a pressure chamber in said housing adapted to contain water, means for heating water in said pressure chamber to a high temperature, and metering means operative to dispense a measured slug of water from said pressure chamber through said outlet port.

3. Apparatus in accordance with claim 2 wherein said metering means is operative in one operating cycle to dispense through said outlet port a series of slugs of water of progressively increased weight.

4. Apparatus in accordance with claim 3 wherein said metering means includes a rotatably mounted circular drum, a plurality of wells formed in said drum in spaced relation along a circumference of said drum, said wells progressively increasing in volume in one direction along said circumference, and a portion of said circumference being in constant communication with said pressure chamber, means for rotating said drum in the direction opposite to said one direction whereby said wells serially aline themselves with said outlet port, and means responsive to the angular position of said drum for stopping its rotation after the largest of said wells has alined with said outlet port and before the smallest of said wells has lost communication with said pressure chamber.

5. Apparatus in accordance with claim 4 and wherein a valve means operable in timed relation with the rotation of said drum functions to open said outlet port only when one of said wells is in substantial alinement with said outlet port.

* * * * *